United States Patent [19]

Artaud et al.

[11] 4,317,504

[45] Mar. 2, 1982

[54] TELESCOPIC AERIAL LADDER

[75] Inventors: Claude Artaud, Challes les Eaux; Henri Ducruet, Cognin, both of France

[73] Assignee: Camiua, Saint-Alban-Leysse, France

[21] Appl. No.: 116,407

[22] Filed: Jan. 29, 1980

[30] Foreign Application Priority Data

Jan. 30, 1979 [FR] France ..... 79 02298

[51] Int. Cl.[3] ..... E06C 5/04

[52] U.S. Cl. ..... 182/67; 182/106; 182/218

[58] Field of Search ..... 182/64, 65, 66, 67, 182/68, 207, 106, 218; 52/118, 119, 632

[56] References Cited

U.S. PATENT DOCUMENTS 380,733 4/1888 Steck ..... 182/66

2,923,381 2/1960 Wilkinson ..... 52/118

4,094,381 6/1978 Wilkerson ..... 182/67

*Primary Examiner*—Reinaldo P. Machado

*Attorney, Agent, or Firm*—Stevens, Davis, Miller & Mosher

[57] ABSTRACT

The invention relates to a telescopic aerial ladder, especially intended to be mounted on a transportation vehicle. Said ladder comprises a number of ladder members superposed on each other, each member consisting of two trapezoidal lateral wings connected by rungs. The upper and lower longitudinal edges of each member are not in parallel relationship but designed in such a manner that the distance between said edges is increasing towards the end of said member which remains imbedded within the corresponding end of another ladder member which is located near below said member.

2 Claims, 6 Drawing Figures

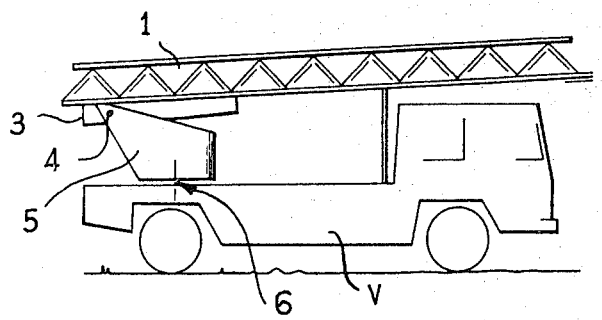
FIG_1
FIG_2
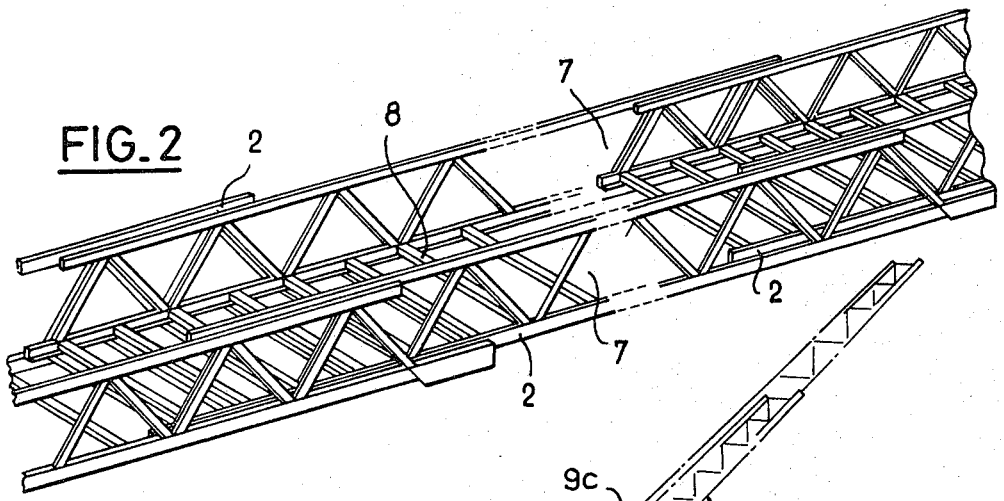
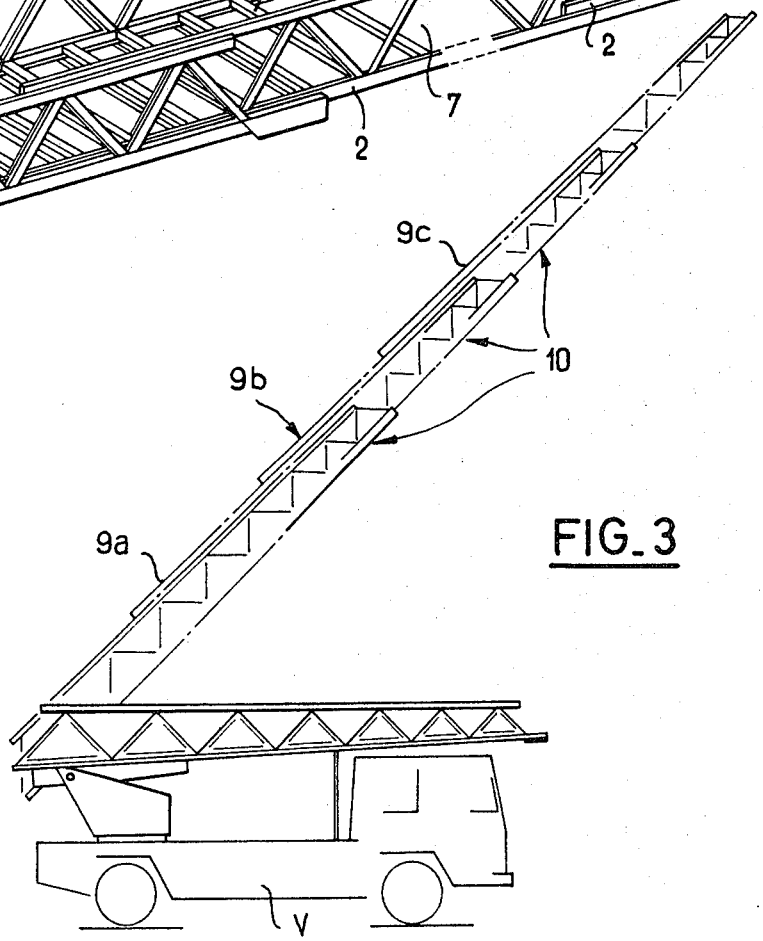
FIG_3

TELESCOPIC AERIAL LADDER

The present invention is directed to a telescopic aerial ladder structure intended to be mounted on an automotive vehicle, and relates more particularly to an aerial ladder to be used in fire-extinguishing and/or life saving procedures.

Up to now, ladders of such type were each constituted of a ladder set comprising a number of telescopically arranged members or so called "ladder plan", so arranged as to enable the spread-out length of a ladder to be varied.

In general, such ladders are each characterized by the envelope materialized by the points which could be reached by the upper end of the ladder with respect to the load exerted thereon. Said envelope, so called "schedule of use", results from the limitation set by the turn-over steadiness of the vehicle or framework on which is mounted the ladder, and from that set by the bending strength of the ladder constitutive members. Said members are generally U-shaped in cross-section, said U-section consisting of two lateral uprights imparting a certain bending strength and useful as guard-rails, said uprights being connected with each other by means of rungs. Each beam of each ladder set in commonly known ladders has a constant length.

The aim of the present invention is, as to solve the problem implicated by the strength/weight ratio proper to a ladder structure of this type, to provide an aerial telescopic ladder characterized in that it comprises a number of ladder members superposed on each other, each member consisting of two trapezoidal lateral wings connected by rungs, the upper and lower longitudinal edges thereof being not in parallel relationship but designed in such a manner that the distance between said edges is increasing towards the end of said member which remains imbedded within the corresponding end of another ladder member which is located near below said member. Each wing may consist of an upper longitudinal upright and of a lower longitudinal upright connected by a lattice, the distance between the relative upper and lower longitudinal edges thereof being not constant.

Such a structure enables, without increasing the overall length of the vehicle where the ladder is set for transportation, an important improvement of the safe load/weight ratio of the ladder set to be obtained. This ratio improvement may be used either for the maximal load admissible at the end of the ladder and relating to a predetermined schedule of use, or to extend the limits of the schedule of use corresponding to a predetermined load. Such improvements are particularly valuable in the case of ladders used in life-saving and fire-extinguishing procedures.

Another object of this invention is to improve the safety by increasing the mean height of each ladder member which also acts as guard-rail. Finally, the steadiness of the vehicle or framework to turn-over is improved not only due to the fact that the weight of the ladder structure is reduced according to the invention, but also due to the fact that the center of gravity of each ladder member is nearer to the low end thereof.

Other objects and advantages of the invention will become more apparent when reference is made to the following description and the accompanying drawing wherein:

FIG. 1 is a lateral view of a known aerial ladder mounted on a transportation vehicle;

FIG. 2 is a perspective view which shows in detail the members constituting the ladder of FIG. 1;

FIG. 3 is a side-view of a telescopic aerial ladder according to the invention, mounted on a transportation vehicle;

Figures 4, 5, 6:
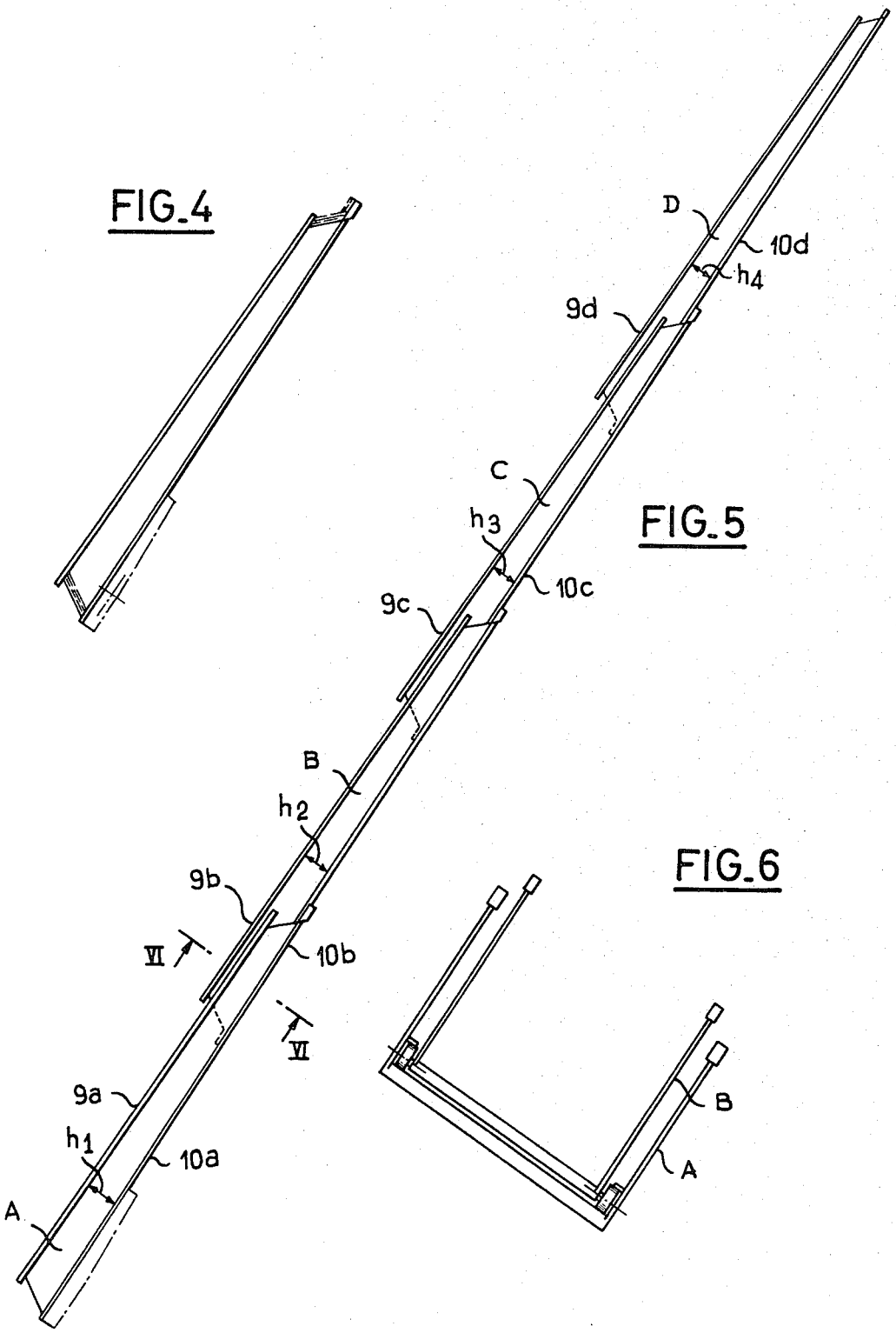
FIG. 4 is a side view of the ladder of the invention.
FIG. 5 is a side view of the ladder of the invention, when spread out.
FIG. 6 is a cross-section along line VI—VI in FIG. 5.

As partially or wholly shown in FIGS. 1 and 2, the aerial ladder of the known art respectively consists of an assembly 1, so called "ladder set", comprising a plurality of telescopic members 2, so called "ladder plan", so designed as to vary the spread-out length of the aerial ladder. The ladder set is properly attached to a frame 3 so as to enable the aerial ladder to be erected by a suitable rotation of the assembly around the horizontal axis 4. In the case where the ladder assembly is permanently bonded to the transportation vehicle, provision is made of a turret 5 which enables the azimuthal orientation of said assembly with respect to vehicle V by means of a suitable rotation of said assembly about the vertical axis 6.

Each ladder member has a general U-shaped cross-section and comprises two lateral wings 7 acting as guard-rails and intended to impart a certain bending strength, said wings 7 being secured to each other by means of rungs 8. In the common ladders of the known art, the distance between the two longitudinal edges of each wing in the respective ladder member is constant.

In the embodiment shown in FIGS. 3–6, provision is made of a certain number of ladder members A, B, C, D . . . , each comprising two trapezoidal-shaped wings, the upper (*9a, 9b, 9c, 9d* . . . ) and lower (**10*a*, 10*b*, 10*c*, 10*d*** . . . ) uprights of which are not in parallel relationship but arranged in such a manner that the distance $h_1$, $h_2$, $h_3$, $h_4$ between the respective upright is increasing towards the end of the corresponding ladder member, which remains imbedded within the end region of another member which is located near below said member.

Such an arrangement obviously enables the bending moment of inertia of each ladder member to be largely increased within the region where said bending moment is maximum.

Further, the arrangement according to the invention enables the length of the ladder set to be increased as regards the portion thereof which is not arranged above the cab of the transportation vehicle, and, as a result, the strength of the ladder members is largely improved due to the fact that the largest stresses are applied to said portion. By way of example, as a result of the comparison between a conventional structure (as shown in FIG. 1) and a structure according to the invention (as shown in FIG. 3), both having the same weight and being made of similar lattices, it is now possible to increase of about 33% the useful load at the ladder end when using the structure of the present invention, while maintaining identical stresses and deformations for both structures. Besides, the guiding devices for the ladder members of the invention are those commonly used in the art, and there is shown in FIG. 5 a possible guiding arrangement.

As many embodiments and modifications may be made of this inventive concept, it is to be understood that all matter hereinabove described is to be interpreted merely as illustrative and not in a limiting sense.

What is claimed as new is:

1. A telescopic aerial ladder comprising: a plurality of ladder members telescopically coupled together in a manner permitting them to be superposed on one another and extended apart a predetermined amount while remaining coupled together, each said ladder member comprising a pair of trapezoidal lateral guard rail wings interconnected by a plurality of rungs extending between said wings and spaced along the length of said wings, each said wing comprising at least an upper longitudinal upright member and a lower longitudinal upright member interconnected by a lattice structure, the distance between the relative upper and lower longitudinal edges of said wings continuously increasing from a first end to a second end of each of said ladder members, the second end of an uppermost ladder member being embedded during extension in the first end of a next lowermost ladder member, said lateral guard rail wings remaining uniformly spaced by said rungs in each said ladder member.

2. A telescopic aerial ladder as in claim 1 further comprising means for mounting said ladder to a vehicle.

* * * * *

UNITED STATES PATENT AND TRADEMARK OFFICE

CERTIFICATE OF CORRECTION

PATENT NO. : 4,317,504

DATED : March 2, 1982

INVENTOR(S) : Claude ARTAUD, et al.

It is certified that error appears in the above-identified patent and that said Letters Patent are hereby corrected as shown below:

On the first page in item [73], change the Assignee's name from "Camiua" to --Camiva--.

Signed and Sealed this

*Third* Day of *August 1982*

[SEAL]

*Attest:*

GERALD J. MOSSINGHOFF

*Attesting Officer*

*Commissioner of Patents and Trademarks*